US006398431B2

(12) United States Patent
Kimura et al.

(10) Patent No.: US 6,398,431 B2
(45) Date of Patent: Jun. 4, 2002

(54) PAGE-TURNING DEVICE, AND PRINTER USING SAME

(75) Inventors: Hiroshi Kimura, Chigasaki; Takako Hojo, Fujisawa, both of (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/808,539

(22) Filed: Mar. 14, 2001

(30) Foreign Application Priority Data

Mar. 16, 2000 (JP) ..... 2000-074222

(51) Int. Cl.[7] ..... B41J 3/28
(52) U.S. Cl. ..... 400/27; 400/24
(58) Field of Search ..... 400/24, 25, 26, 400/27, 28; 84/486, 487

(56) References Cited

FOREIGN PATENT DOCUMENTS

JP 3-292172 * 12/1991 ..... 400/24

OTHER PUBLICATIONS

IBM Technical Disclosure Bulletin, Oct. 1987, vol. 30, No. 5, pp. 4–6.*

* cited by examiner

*Primary Examiner*—Daniel J. Colilla
(74) *Attorney, Agent, or Firm*—Lawrence R. Fraley

(57) ABSTRACT

In a page-turning device for a printer, arms are provided at the ends of a support shaft, and a pair of rollers are fitted around a roller shaft that is located between the distal ends of arms. Springs are attached to the base ends of the arms to press the rollers against a medium to be printed. Depending on the width of the medium, the positions of adjustment brackets can be changed, such that the urging forces produced by the springs are adjusted, so as to control the pressing forces exerted by rollers, thereby assuring substantially uniform force application onto at least two locations of the page such that the page can be readily turned without inappropriate folding, bending or creasing.

8 Claims, 7 Drawing Sheets

PAGE-TURNING DEVICE, AND PRINTER USING SAME

TECHNICAL FIELD OF THE INVENTION

The present invention relates to: (1) a page-turning device, e.g., for a passbook updating machine or an automatic teller machine, that can easily cope with the individual widths of variable-width, multi-leaved media, such as passbooks so that the turning of the pages of such media can be performed precisely; (2) to a printer, e.g., for such a passbook; and (3) to a method for adjusting a setting for such a page-turning device.

BACKGROUND OF THE INVENTION

As is well known, passbook updating machines and automatic teller machines (so-called ATMs), which are installed in financial facilities, must handle passbooks having a plurality of pages (one example of what shall be referred to herein as multi-leaved media). By the term "passbook" as used herein is meant to include a multi-page, commonly bound (e.g., along a spine) book or the like (such as a bank passbook) wherein the individual pages must be turned over to expose information on the next, succeeding page. In practice, a user of one of these devices opens his or her passbook to the latest (or multi-page) printed page, and inserts the passbook into the automated teller machine, or into the passbook updating machine, so that it can be updated in accordance with the current transaction (or so that previously acquired magnetic information can be recorded, as needed). When the printing on the page that is thus exposed extends up to the end of the last line, or when the last line of the page of the passbook that was inserted has already been printed, a page-turning device automatically turns the page of the passbook and exposes the next page.

An example of a page-turning device such as mentioned above is shown in FIG. 10. The page-turning device in FIG. 10 includes two rollers, 1L and 1R. These rollers 1L and 1R are integrally formed with a roller shaft 2, so that these rollers are rotated as a motor (not shown) rotates the roller shaft 2 via a drive belt 3. Further, both ends of roller shaft 2 are supported by a support shaft 5, via arms 4L and 4R. Arms 4L and 4R are pivoted at the support shaft 5, rollers 1L and 1R are shifted between a position of contact with the surface of a page of a passbook, and a position where no contact occurs (the rollers being separated from the surface of the page). Springs 6L and 6R respectively engage the bases of arms 4L and 4R, while also engaging a bracket 7 that is secured to the main body of the print mechanism (not shown). Pins 8, which are used to provide support for support shaft 5, are fitted into arms 4L and 4R, but when support shaft 5 is rotated, in the direction indicated by (a) in FIG. 10, a distance equivalent to a predetermined angle, pins 8 are disengaged from arms 4L and 4R.

For a page of a passbook to be turned by the page-turning device in FIG. 10, while the passbook (in phantom) is held stationary, support shaft 5 is rotated, by the motor (not shown), a distance equivalent to a predetermined angle, and pins 8 are disengaged from arms 4L and 4R. Then, arms 4L and 4R are pivoted by the force exerted by springs 6L and 6R, and rollers 1L and 1R are pressed against the surface of the page therebelow. In this state, rollers 1L and 1R are rotated by the motor (not shown) and draw the edge of the page toward the center (spine) of the passbook where the pages are bound together. As rollers 1L and 1R are rotated further, the page is lifted until it rests on rollers 1L and 1R, so that thereafter, to turn the page over, the passbook need only be moved in the direction indicated by an arrow (b). In this fashion, the turning of a page is completed.

Passbook sizes are standardized in Japan; however, in other countries the sizes (especially the widths) of passbooks are not always standardized, and passbooks of various sizes, within a range, for example, of 120 mm to 180 mm, must be handled by individual financial facilities.

In order to turn the pages of passbooks having various sizes, it is preferable that in each instance rollers 1L and 1R be symmetrically located relative to the center of a passbook. If rollers 1L and 1R are offset to either side of the center of the passbook, the distance a page is rolled up at one end may differ from the distance it is rolled up at the other end, so that the page will not be rolled up evenly and it will either not be turned over or it will be folded.

However, for the manufacturer of passbook updating machines and automatic teller machines, the sizes of passbooks employed by users are not always available before factory production is begun, thus making it impossible to position rollers 1L and 1R in consonance with the sizes of such passbooks.

Therefore, when a machine is delivered to a financial facility, representatives of the delivery service or of the user must set up the machine in accordance with the sizes of the passbook that is used by the facility. This, however, can be a troublesome operation.

OBJECTS AND SUMMARY OF THE INVENTION

To resolve these and related technical problems, it is one object of the present invention to provide a page-turning device for which settings can be easily and exactly changed in accordance with the width of a passbook that is used and with which, thereafter, the turning of passbook pages can precisely be performed.

It is another object of the invention to provide a passbook printer which includes as part thereof a page-turning device as taught herein.

It is yet another object of the invention to provide a method for adjusting settings on a passbook page-turning device.

According to one aspect of the present invention, a page-turning device is provided for turning a page of a multi-leaved medium including a plurality of bound pages, the device comprising a multi-leaved medium feeding mechanism for feeding and halting the multi-leaved medium in an open state, a plurality of rollers, which are positioned opposite the surface of a page of the multi-leaved medium and are rotated by a drive source, and a pressing member, for pressing the plurality of rollers against the surface of the page, and for adjusting the pressing force applied by at least one of the rollers.

According to another aspect of the present invention, a passbook printer is provided for printing transaction information on at least one page of a passbook having multiple pages, the printer comprising a printing mechanism for printing the transaction information on a specific page of the passbook, a passbook feed mechanism for feeding of the passbook toward or away from the print mechanism, and a page-turning device for turning the page of the passbook, wherein the page-turning device includes a plurality of rollers positioned opposite the surface of the page of the passbook in the open state for rotating and turning the page. This device is capable of moving in the width direction of the passbook while a pressing member adjusts the roller pressure to thus compensate for differing width passbooks.

Furthermore, according to the present invention, a method is provided for adjusting the setting of a page-turning device, wherein pressing force is applied by a pair of rollers to a page of a multi-leaved medium including multiple bound pages The page is rolled up toward the bound portion of the multi-leaved medium as the rollers are rotated, and a multi-leaved medium feeding mechanism moves the multi-leaved medium forward or rearward along the surface of the page-turning device so that the page is turned. The method further comprising the steps of determining whether values set for pressing forces exerted by the rollers match the width of the multi-leaved medium, and changing the pressing force, in accordance with the width of the multi-leaved medium, exerted by one of the rollers while maintaining the pressing force exerted by the other roller when the values set for the pressing force do not match the width of the multi-leaved medium.

BEST MODE FOR CARRYING OUT THE INVENTION

The present invention will now be described in detail while referring to the accompanying drawings.

Figure 1:
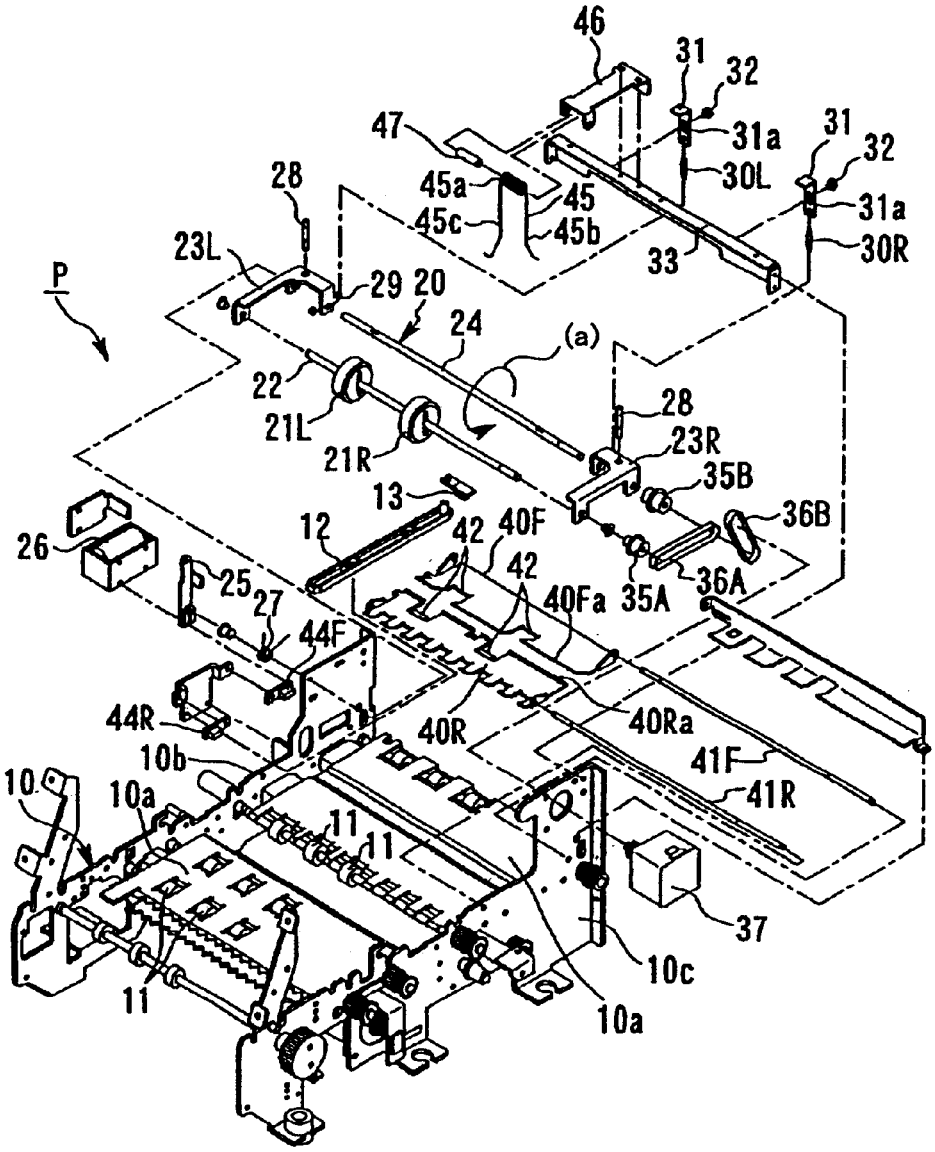
FIG. 1 is an exploded perspective view, according to one embodiment of the invention, of a passbook printer which includes a page-turning device, also in accordance with one embodiment of the invention.
Figure 2:
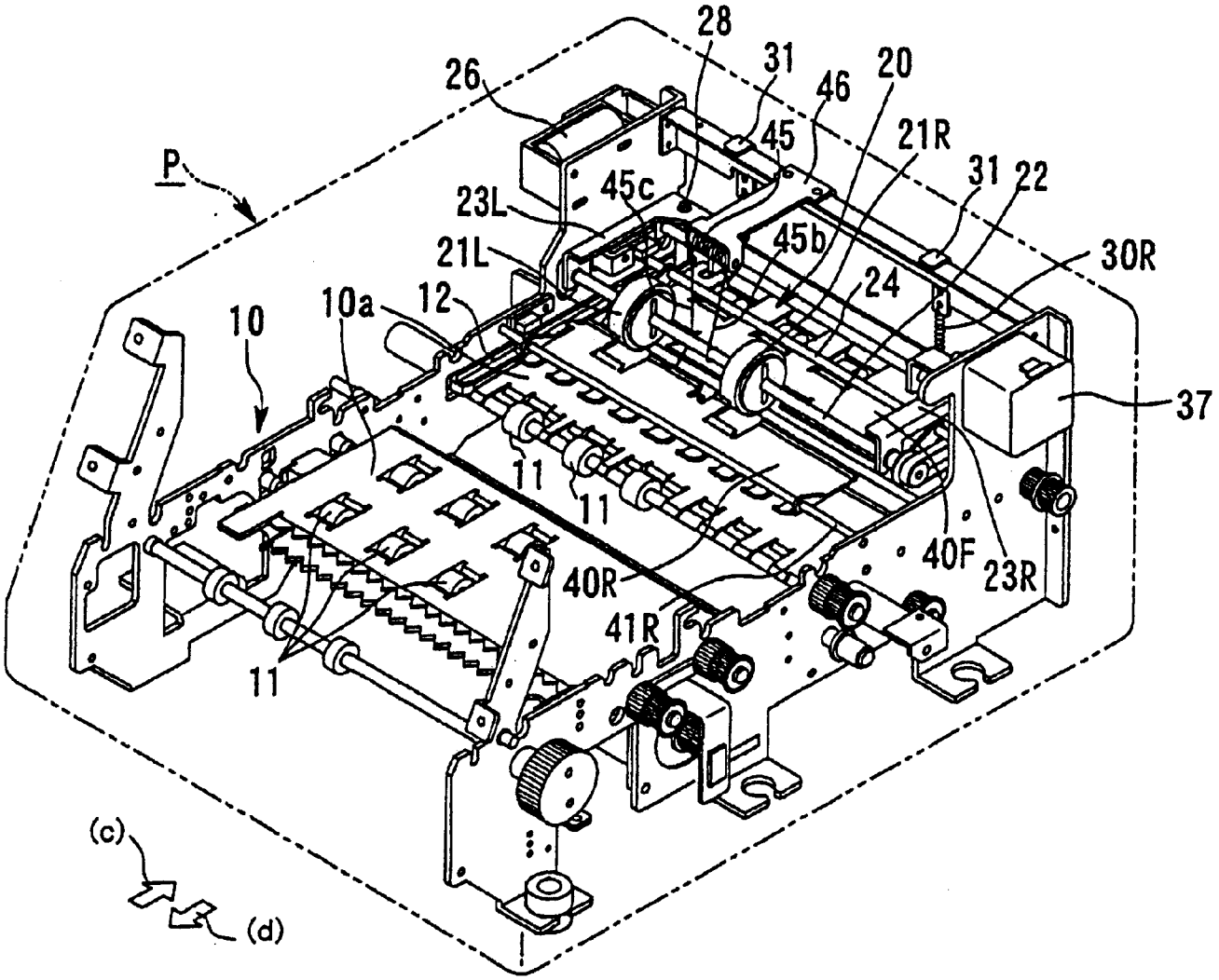
FIG. 2 is a perspective view of FIG. 1 showing the printer assembled.

FIG. 1 is an exploded perspective view illustrating the general arrangement of a page-turning device 20 according to one embodiment, and FIG. 2 is a perspective view of the device in FIG. 1 after it has been assembled. The page-turning device is provided as a part of a passbook printer (P) that is installed, for example, in a passbook updating machine or an automatic teller machine. Passbook printer P comprises a base frame 10 and page-turning device 20, and of course other elements known in the art for such devices. The base frame 10 conveys a passbook (multi-leaved medium described further below) that is inserted into and removed from the passbook printer P in the directions indicated by arrows (c) and (d) (FIG. 2), respectively. The passbook during such movement is oriented on surfaces 10*a*. A plurality (shown in FIGS. 1 and 2) of rollers 11, which constitute a multi-leaved medium feed mechanism, are arranged at intervals within surfaces 10*a*. The upper faces of the feed rollers 11, which are rotated by a drive motor (not shown), are exposed upward through spaced openings in surfaces 10*a*. The rotation direction for rollers 11, the rotation distance, and the rotation/halting timing of the drive motor (not shown) are all preferably controlled by a control unit (also not shown), several of which are well known in the art and further description is not needed. With this arrangement, as feed rollers 11 are rotated in contact with the bottom of the passbook, the passbook can be moved forward and rearward in the directions indicated by arrows (c) and (d). When feed rollers 11 are halted, the passbook is, understandably, held at a fixed position within the printer or has been removed therefrom.

A positioning guide 12 is secured at a predetermined position on base frame 10. Positioning guide 12 is positioned along one sidewall 10*b* (FIG. 1) of base frame 10 in order to position one side end of the inserted passbook and to guide the passbook in the feeding direction.

Printer P further includes the aforementioned page-turning device 20 which, in turn, includes a pair of rollers 21L and 21R. These rollers 21L and 21R are integrally formed with a roller shaft 22 which is supported by a support shaft 24 by fitting both ends of roller shaft 22 into arms 23L and 23R. Shaft 24 is also positioned within arms 23L and 23R, as best seen in FIG. 1. Specifically, the support shaft is rotatably fitted into sidewalls 10*b* and 10*c* of base frame 10, and as arms 23L and 23R pivot at support shaft 24, rollers 21L and 21R can approach and move away from bottom faces 10*a* of base frame 10, e.g., can be moved forward and rearward between the position where rollers 21L and 21R contact the surface of the page of the passbook placed on surface 10*a*, and the position where the rollers are then separated from the surface of said passbook's page.

A lever member 25 (FIG. 1) is integrally secured at one end of support shaft 24, and a support shaft drive source 26 (e.g., such as a solenoid) connected to its distal end rotates the support shaft 24 in a predetermined direction. A recovery spring 27 (FIG. 1) is located between lever member 25 and sidewall 10*b* of base frame 10 in order to urge lever member 25 in the direction opposite to the driving direction of drive source 26. With this arrangement, when drive source 26 is activated, lever member 25 is rotated in a predetermined direction against the urging force of recovery spring 27, so that support shaft 24 is also rotated for an established distance and in a predetermined (clockwise or counterclockwise, depending) direction.

Pins 28, each of which is located at one end of support shaft 24, are normally fitted into holes formed in arms 23L and 23R, but when support shaft 24 is rotated a distance represented by a predetermined angle in the direction indicated by arrow (a) in FIG. 1, the pins 28 are removed from arms 23L and 23R.

Protrusions 29, one of which is formed on each of arms 23L and 23R, project outward in the direction, relative to support shaft 24, opposite that of roller shaft 22 and are engaged by the ends of springs 30L and 30R, which serve both as pressing and urging members. The other ends of springs 30L and 30R engage the lower ends of adjustment brackets 31, which in cross section have a substantially L shape and which serve as a pressing force adjustment mechanism, so that when pins 28 are removed from arms 23L and 23R, arms 23L and 23R are pivoted, forcing page-turning rollers 21L and 21R downward.

Adjustment brackets 31 are attached to a support bar 33, which is fixed to base frame 10, by fixing members 32, such as screws, that are inserted through elongated adjustment holes 31*a* formed in adjustment brackets 31. Thus, the position of each adjustment bracket 31 can be adjusted vertically, within a range corresponding to the length of the respective adjustment hole 31*a*, by loosening fixing screw 32 that secures the adjustment bracket to the support bar. For this vertical adjustment, each adjustment bracket 31 can be easily positioned at various incremented positions relative to the upper face of support bar 33 (e.g., along marked positions formed on support bar 33).

When the vertical position of an adjustment bracket 31 is changed, the length of the corresponding spring (30L or 30R) secured thereto is also changed, thereby altering the urging force provided by the spring, while simultaneously adjusting the pressing force exerted by the corresponding page-turning roller (21L or 21R). Clearly, both brackets can be adjusted to in turn alter the respective forces exerted by both pairs of rollers associated with each bracket.

Pulleys 35A and 35B and belts 36A and 36B are positioned outside arm 23R. Pulley 35A is fixed to one end of roller shaft 22, while pulley 35B is rotatably supported by arm 23R. Belt 36A is stretched around pulleys 35A and 35B, while belt 36B is stretched around pulley 35B and the drive shaft of a roller driving motor (drive source) 37, which is positioned outside sidewall 10*c* of base frame 10. When roller driving motor 37 is activated, rotational force is transmitted via pulleys 35A and 35B and belts 36A and 36*b* to roller shaft 22. Rollers 21L and 21R are thus rotated.

In the vicinity of rollers 21L and 21R, a forward guide plate 40F is located in Printer P along the passbook forward feeding direction (indicated by the arrow (c) in FIG. 2), while a rearward guide plate 40R is located in the passbook rearward feeding direction (indicated by the arrow (d) in FIG. 2). Forward guide plate 40F and rearward guide plate 40R are rotatably supported at the ends thereof by the respective shafts 41F and 41R, shafts 41F and 41R being supported in turn by side walls 10*b* and 10*c* of base plate 10. Thus, forward guide plate 40F and rearward guide plate 40R are each pivotable at the respective shafts 41F and 41R, so that the edges of plates 40F and 40R approach but are separated from rollers 21R and 21L (these plates each including two cut-out portions 42 for this purpose). Also, the distal ends of forward and rearward guide plates 40F and 40R are each seen as being slightly bent upward in FIGS. 3 and 4.

In addition, sensors 44F and 44R are formed on the ends of the forward and rearward guide plates 40F and 40R, for detecting dogs being located on the side wall 10*b* of base plate 10. Sensors 44F and 44R detect when forward and rearward guide plates 40F and 40R are pivoted predetermined angles.

Forward and rearward guide plates 40F and 40R each have a protrusion (FIG. 1) positioned on the adjacent positioning guide 12 at a predetermined distance from bottom surface 10*a* of base frame 10. A stopper spring 45 is provided in order to prevent forward and rearward guide plates 40F and 40R from being moved upward (e.g., by a raised portion of a warped passbook). Stopper spring 45 is supported, via a support sleeve 47, by a bracket 46 that is attached to support bar 33. Stopper spring 45 has a coil 45*a* at its center, and support sleeve 47 is inserted into coil 45*a*. Engagement portions 45*b* and 45*c* extend downward from the coil, pass on either side of roller shaft 22 in the assembled state in FIG. 2, and are bent so that these intersect each other on the lower face of roller shaft 22. On the upper face side of forward guide plate 40F, the distal end of engagement portion 45*b* restricts the upward movement of guide plate 40F, while on the upper face side of rearward guide plate 40R, the distal end of engagement portion 45*c* restricts the upward movement of guide plate 40R. This relative motion and positioning is better illustrated in FIGS. 3–6 below.

Figure 3:
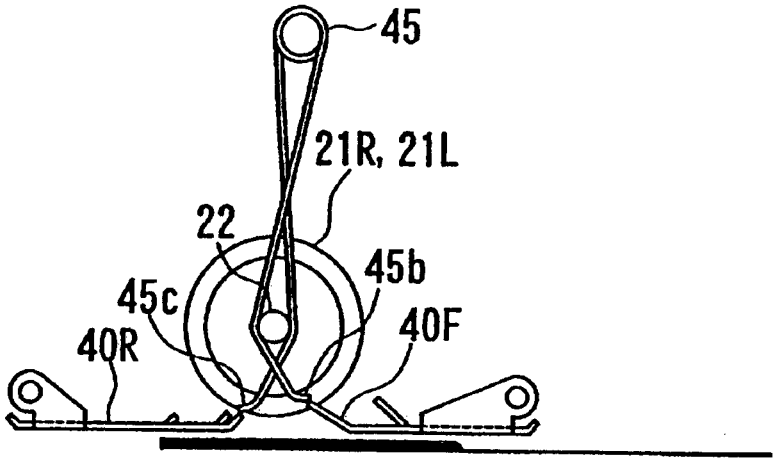
FIG. 3 is a partial side view showing the state wherein rollers begin to descend during the page-turning process performed by the page-turning device of the invention.
Figure 4:
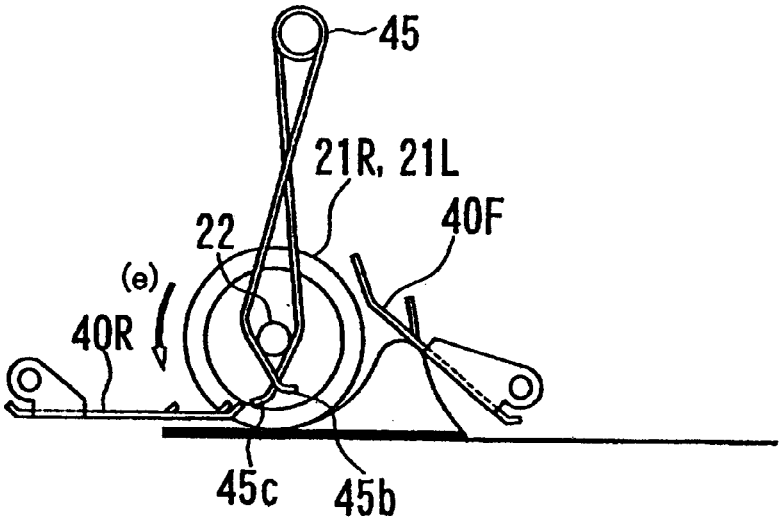
FIG. 4 is a partial side view showing the step following that in FIG. 3, where a page is rolled up by the rollers.

When roller shaft 22 descends, bent engagement portions 45*b* and 45*c* are separated from each other (compare FIGS. 3 and 4), and the distal ends of the two portions 45*b* and 45*c* are disengaged from forward and rearward guide plates 40F and 40R, respectively, to form a gap between both plates (FIG. 4). Forward guide plate 40F and rearward guide plate 40R can then be pivoted at the respective shafts 41F and 41R.

As described above, the passbook printer P, including page-turning device 20, is, for example, incorporated in a passbook updating machine or an automatic teller machine. In addition to the above components, the passbook printer P further includes printing means for printing predetermined transaction information, such as for a withdrawal or a deposit, on a predetermined page of a passbook, page identification means for using a mark at a predetermined position to identify the page to which the inserted passbook is opened and determination means for employing the results obtained by the identification means to determine whether the page of the passbook should be turned. These components are known in the art and further description is not believed necessary.

When a passbook (shown by the darker, bottom horizontal line in FIGS. 3–6 and the thinner line projecting from the right side of the darker line) is opened and inserted into the passbook printer P, the passbook is fed rearward (the direction indicated by the arrow (c)) across bottom faces 10*a* of base frame 10 by rotating feed rollers 11. Predetermined transaction information is printed on the designated page by the printer's printing means. At this time, the page identification means identifies the page to which the inserted passbook is opened. Then, when the printing of the page reaches the final line, or if the final line of the page has already been printed, the determination means ascertains that the page must be turned, and the page is automatically turned by turning device 20.

The page-turning device 20 turns the page of the passbook in the following manner. To turn the page forward, the passbook on bottom faces 10*a* of base frame 10 is fed by rotating rollers 11. At this time, rollers 21L and 21R are retracted upward, and therefore do not hinder the movement of the passbook. Then, the leading edge of the passbook is detected by sensor 13 (FIG. 1), which is positioned at a predetermined location on positioning guide 12, and the passbook is fed by the step control motor that drives rollers 11 until the second page of the passbook in the feeding direction is positioned immediately below rollers 21L and 21R. Thereupon, feed rollers 11 are halted, and, due to the friction produced by feed rollers 11, the passbook is halted and held at that location (as seen in FIG. 3). The thicker part of the passbook (that with more pages needing to be turned) lies directly under rollers 21L and 21R in FIG. 3.

Then, support shaft drive source 26, such as a solenoid valve, is driven to rotate support shaft 24 in a predetermined direction via lever member 25, until, when support shaft 24 has been rotated through a predetermined angle, pins 28 are removed from arms 23L and 23R. After arms 23L and 23R are thus released, these pivot downward by the force exerted by springs 30L and 30R. Rollers 21L and 21R are pressed against the surface of the page of the passbook (FIG. 4).

At the same time, as roller shaft 22 is moved downward, engagement portions 45*b* and 45*c* of stopper spring 45 are forced apart, releasing forward and rearward guide plates 40F and 40R so that these can also pivot. Plate 40F is shown pivoted upwardly in FIG. 4.

Roller drive motor 37 is now activated to rotate the roller shaft 22, i.e., rollers 21L and 21R are rotated, via pulleys 35A and 35B and belts 36A and 36B, in the direction indicated by an arrow (e) in FIG. 4. At this time, since the lower face of the passbook is held by the friction produced by feed rollers 11 (recall: the passbook is resting on these rollers), the page of the passbook is rolled up toward its edge where it is bound to other pages (toward the center of the opened passbook), until in cross section it is shaped substantially like a "mountain" (FIG. 4). Accordingly, forward guide plate 40F is pivoted and raised, until sensor 44F determines that forward guide plate 40F has been pivoted through the desired predetermined angle, whereupon power to support shaft drive source 26 is terminated, stopping plate 40F as seen in FIG. 4. Then, support shaft 24 is rotated by the urging force applied by recovery spring 27 (FIG. 1), and rollers 21L and 21R are separated from the passbook and retracted to their original positions. Thus the pressing force exerted on the passbook is removed. At this time, since the page of the passbook still contacts rollers 21L and 21R, the "mountain" shape of the page in cross section is maintained by the friction produced by rollers 21L and 21R.

Figure 5:
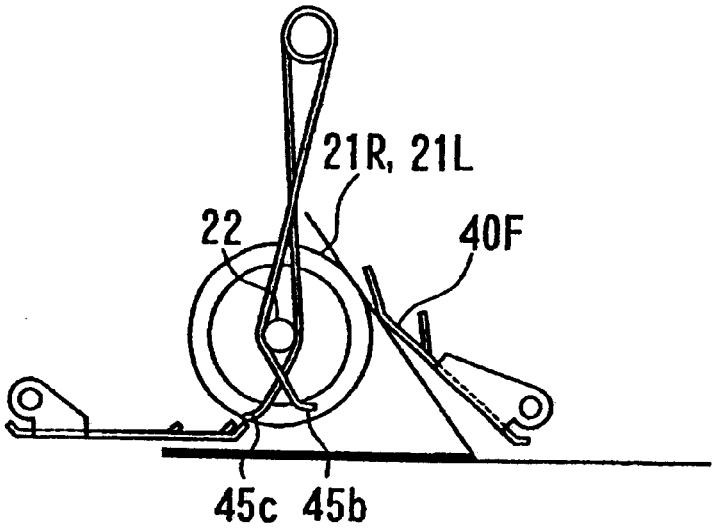
FIG. 5 is a partial side view showing the step following that in FIG. 4, where the page is pulled upwardly onto the rollers as the rollers are rotated quickly.

Then, as shown in FIG. 5, rollers 21L and 21R are quickly rotated in the same direction (the direction indicated by the arrow (e) in FIG. 4), so that the page that is contacting rollers 21L and 21R is moved abruptly upward and, as a result, is returned to its original flat shape by its own inherent elasticity. The page is also inclined forward, resting on rollers 21L and 21R, as seen in FIG. 5. At this time, forward guide plate 40F is pressed against the inclined page from above so that the page is sandwiched between rollers 21L and 21R and forward guide plate 40F.

Figure 6:
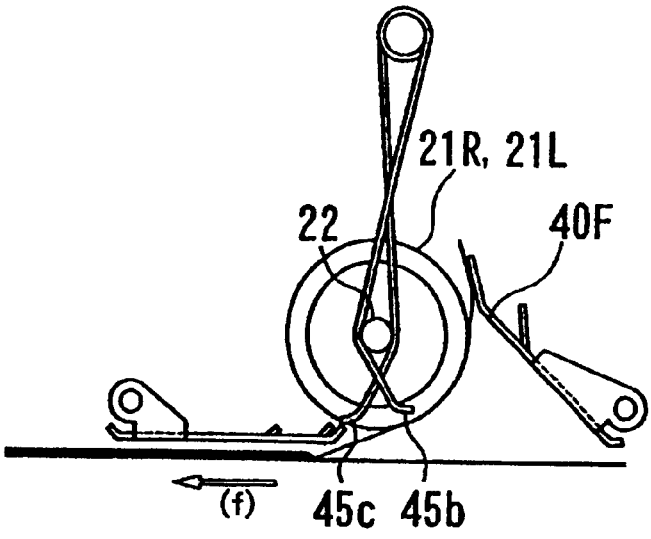
FIG. 6 is a partial side view showing the step following that in FIG. 5, where the page is turned over by feeding the passbook under the rollers.

Thereafter, as shown in FIG. 6, feed rollers 11 (FIG. 2) are rotated to feed the passbook in the direction indicated by an arrow (f), which is opposite the original feed direction on rollers 11 into the printer, so that the page, which is inclined upward, passes under rollers 21L and 21R and is thereby turned over.

In this state, when the passbook is moved while separated from rollers 21L and 21R, forward guide plate 40F is closed by its own weight, but is held by engagement portion 45*b* of stopper spring 45. Therefore, support shaft driving source 26 is driven only a short period of time and raises roller shaft 22 only a slight distance so that engagement portions 45*b* and 45*c* of stopper spring 45 approach each other and the distal ends thereof moved to the gap between forward and rearward guide plates 40F and 40R. Therefore, because of its own weight, the distal end of forward guide plate 40F drops until it is lower than the distal end of engagement portion 45*b*, support shaft drive source 26 is halted, and roller shaft 22 is returned to its original position. In this fashion, engagement portions 45*b* and 45*c* of stopper spring 45 are returned to their original positions above forward guide plate 40F and rearward guide plate 40R, and the movement of guide plate 40F is restricted. Thereafter, the passbook is fed by feed rollers 11 in a predetermined direction, and subsequent page-turning steps can be performed.

During the above page-turning processes, if the page identification means detects that two or more pages were wrongfully turned, or that the inserted passbook was opened to a page following the page at which printing should be performed, the rearward feeding operation of the page-turning device 20 is actuated, e.g., by a controller (not shown). For this operation, the passbook is fed by feed rollers 11 until the leading edge of the passbook is detected by sensor 13. Then, using the step control motor that drives feed rollers 11, the passbook is returned until the forward page of the passbook in the feeding direction is immediately under rollers 21L and 21R. Then, in the same manner as for the forward feeding, support shaft 24 is rotated by the support shaft drive source 26, such as a solenoid valve, arms 23L and 23R are removed from pins 28, and rollers 21L and 21R are pressed against the surface of the page of the passbook by the urging force provided by springs 30L and 30R. At the same time as roller shaft 22 is moved downward, forward guide plate 40F and rearward guide plate 40R are released from stopper spring 45.

Following this, when rollers 21L and 21R are rotated, the forward page of the passbook is rolled up until in cross section it is shaped substantially like a "mountain" as defined earlier above, and, accordingly, rearward guide plate 40R is raised. When sensor 44R detects that rearward guide plate 40R has been pivoted through a predetermined angle, sensor 44R (FIG. 1) halts support shaft drive source 26, following which, due to the urging force exerted by recovery spring 27, rollers 21L and 21R are separated from the passbook, and the pressing force is removed. At this time, since the page of the passbook still contacts rollers 21L and 21R, the "mountain" shape of the page in cross-section is maintained.

Then, when rollers 21L and 21R are quickly rotated by roller drive motor 37, the page that is contacting rollers 21L and 21R is moved abruptly upward and is inclined, resting on rollers 21L and 21R. At this time, the page is sandwiched between rollers 21L and 21R and rearward guide plate 40R, much the same as the page in FIG. 5 was retained. Thereafter, feed rollers 11 are rotated to feed the passbook, so that the page, which is inclined upward, is passed under rollers 21L and 21R and is turned over in the rearward direction.

In this state, rearward guide plate 40R is held by engagement portion 45*c* of stopper spring 45. Therefore, in the same manner as was described above, support shaft driving source 26 is actuated for only a short period of time in order to raise roller shaft 22 a slight distance, so that engagement portions 45*b* and 45*c* of stopper spring 45 are returned to their positions above rearward guide plate 40R and forward guide plate 40F and the movement of rearward guide plate 40R is restricted. Thereafter, the passbook is fed by feed rollers 11 in a predetermined direction, and the succeeding process, if needed, is performed.

Figure 7:
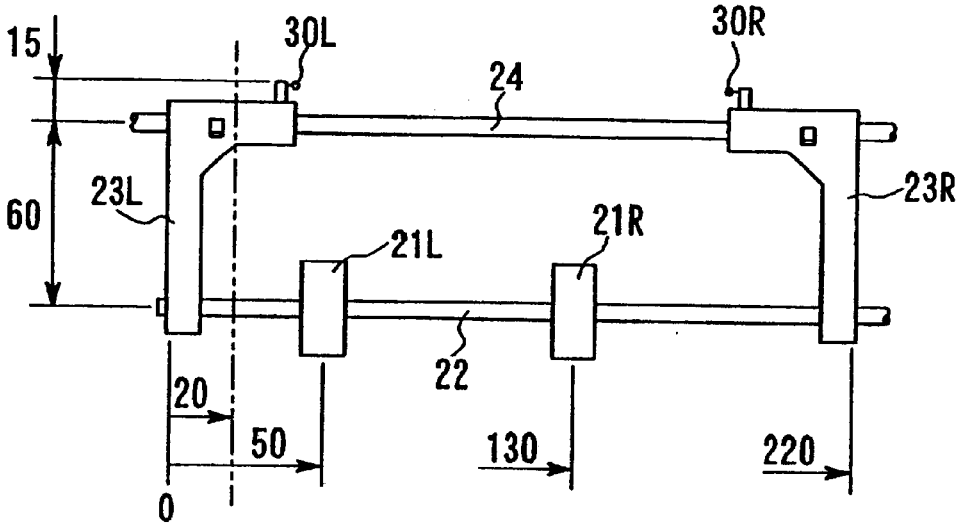
FIG. 7 is a plan view showing the positional relationship of the individual members that constitute the page-turning device according to one embodiment of the invention.

Page-turning device 20 of passbook printer P can thus handle passbooks having various widths, e.g., from 120 to 180 mm. Therefore, rollers 21L and 21R, roller shaft 22, arms 23L and 23R, support shaft 24, springs 30L and 30R, and positioning guide 12, which is the passbook positioning reference, are positioned to accommodate such varying width passbooks. In one example, roller 21R is positioned for a passbook having a width that is not less than a minimum width (e.g., 120 mm), and in order to prevent interference with a page that is being turned, arm 23L is positioned outside (to the left) positioning guide 12, while arm 23R is positioned outside (to the right) the width of a passbook having a maximum width (e.g., 180 mm). FIG. 7 illustrates examples of how rollers 21L and 21R, roller shaft 22, arms 23L and 23R, support shaft 24, springs 30L and 30R, and positioning guide 12 (FIG. 1) are aligned. According to the positional relationship in FIG. 7, for a passbook that has a width (e.g., 140 mm) between the minimum and maximum widths, rollers 21L and 21R are symmetrically located relative to the width at the center of the passbook. That is, selected parts of the page-turning device 20 in FIG. 7 are arranged on the assumption the passbook width is somewhere between the minimum and maximum widths allowed. Therefore, for passbooks having a width in this middle range, rollers 21L and 21R are located asymmetrically relative to the width at the center of the passbook. This means that the center of the interval between the support points of arms 23L and 23R, which support roller shaft 22, is not in line with the center of the interval between rollers 21L and 21R.

The thus arranged page-turning device 20 can alter the positions of adjustment brackets 31 (FIGS. 1 and 2) in accordance with the width of the passbook that is to be handled, and changes the lengths of springs 30L and 30R to adjust the urging forces thereof, so as to alter the pressing force exerted by rollers 21L and 21R. Therefore, the balance between rollers 21L and 21R is adjusted, and the page is rolled up the same distance at both ends thereof.

In this case, the required urging forces for springs 30L and 30R are determined by applying two conditions: (1) the right and left moments are balanced so that roller shaft 22 is held horizontal, and (2) the balance of the moments of arms 23L and 23R is pivoted at the support shaft 24.

Assuming that page-turning device 20 has a roller and arm positional relationship shown in FIG. 7 designed to accept a 140 mm wide passbook, since rollers 21L and 21R are symmetrically located relative to the width at the center of the passbook, the pressing forces exerted by rollers 21L and 21R will be equal. In this example, when a pressing force of 200 (gf) is designated for rollers 21L and 21R, in accordance with the conditions (1) and (2), an urging force of 960 (gf) is set for spring 30L and an urging force of 640 (gf) is set for spring 30R due to the offsetting roller and arm relationship shown.

When the pressing force exerted by roller 21L is a constant (e.g., 200 (gf)), it is preferable that the pressing force exerted by roller 21R be less (e.g., 150 (gf)) for a minimum passbook width (e.g., 120 mm), greater (e.g., 250 (gf)) for a width of 160 mm, and still greater (e.g., 300 (gf)) for a width of 180 mm. The corresponding urging forces for springs 30L/30R, in such an example, are 880/520 (gf) for a passbook minimum width of 120 mm, 1040/760 (gf) for the width of 160 mm, and 1120/880 (gf) for the width of 180 mm.

Such a scale, having various ranges, can be etched on the adjustment bracket 31, for the device operator's reference. Then, when the passbook printer P is installed, the installation company or the operator need only change the positions of adjustment brackets 31 using these scales dependent on the width of passbooks to be turned.

Figure 8:
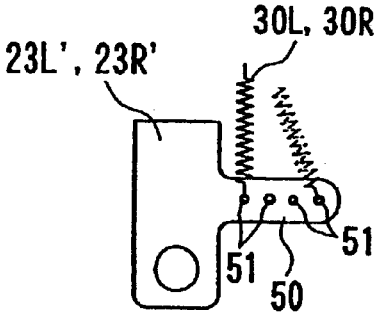
FIG. 8 is a partial side view showing an alternative part of a page-turning device of the invention.

As described above, the pressing forces exerted by rollers 21L and 21R are readily adjustable to achieve a balance, so that regardless of the widths of various passbooks, a page will be uniformly rolled up. Further, the positions of adjustment brackets 31 are also adjustable to control the pressing forces. In these embodiments, members other than the illustrated fixing members 32, such as screws, may be utilized as long as it is relatively easy to perform the positioning change. As seen in FIG. 8, extension portions 50 may be projected to the sides of arms 23L' and 23R', and a plurality of engagement holes 51 may be formed in extension portions 50 and used to change the engagement positions of springs 30L and 30R. As a result, the lengths of springs 30L and 30R will be changed. Further, the locations where the rotation moments act on arms 23L and 23R of springs 30L and 30R will also be changed. And with this change, the pressing forces exerted by rollers 21L and 21R are adjusted.

Figure 9:
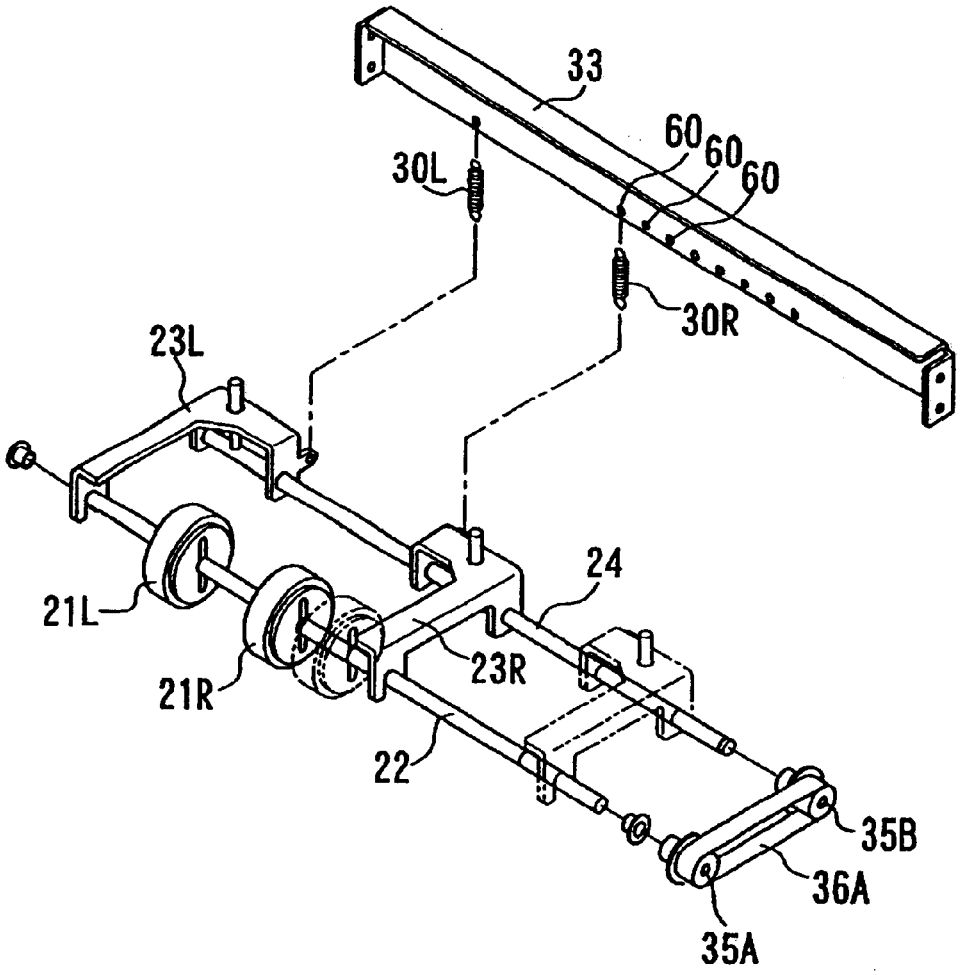
FIG. 9 is an exploded perspective view showing a page-turning device according to another embodiment of the invention.
Figure 10:
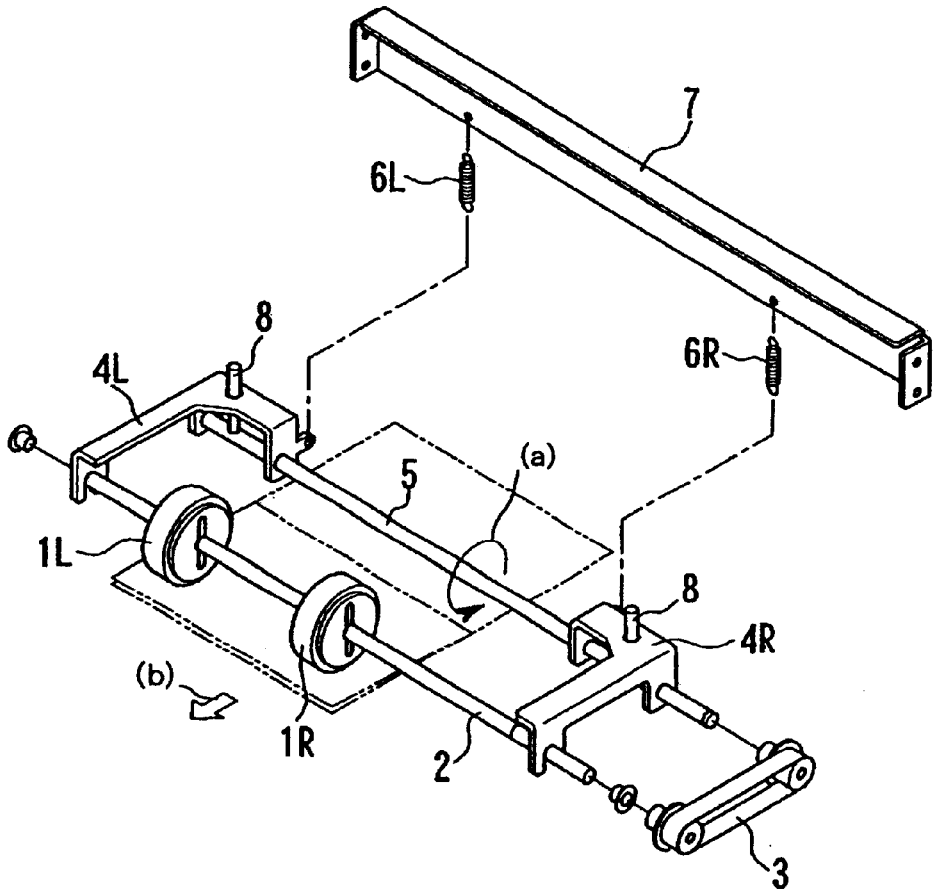
FIG. 10 is an exploded perspective view illustrating the general arrangement of a conventional page-turning device.

In addition, as shown in FIG. 9, an arm 23R may be provided that slides along roller shaft 22 and support shaft 24, and a plurality of engagement holes 60 formed in support bar 33 into which the upper end of spring 30R can be inserted. As the position of arm 23R is changed by sliding, the distance from the point where the urging force of spring 30R acts on roller 21R is changed, and the moment due to the urging force via arm 23R is altered. Using this method, the pressing forces exerted by rollers 21L and 21R can also be easily adjusted, and as in the above examples, the page can be uniformly rolled up, regardless of the widths of various passbooks. Furthermore, in this embodiment, when the setting of page-turning device 20 is to be adjusted for passbooks having various widths, since only arm 23R is be moved and spring 30R re-engaged, the operation is substantially simplified.

In addition, various other modifications of the invention are possible. For example, three or more rollers 21 may be employed instead of only two as shown. And also, so long as the rollers can be moved forward or rearward relative to the surface of the page, instead of the rotation at support shaft 24, an expansion/contraction cylinder may be employed as roller moving means for moving the rollers forward or rearward. Similarly, when the individual roller pairs are pressed against the surface of the page, means other than springs 30 may be used, e.g., air pressure means. When means other than those described above are employed as the roller moving and pressing means, the pressing force adjustment mechanism need only adjust the pressing forces provided by the pressing means and exerted by the individual roller pairs. As a result, the same effects can be obtained. In addition, in the above embodiment, the pressing forces exerted by both rollers 21L and 21R can be adjusted. However, when one of the pressing forces is fixed and the other is adjusted, the same effects can be obtained for a different width medium (passbook). Further, a different structure may be employed as needed for the restriction of support shaft 24 (e.g., using other than pins 28) and the restriction of the movement of forward and rearward guide plates 40F and 40R (e.g., other than stopper spring 45).

As is described above, according to the present invention, since the pressing force exerted by each roller pair is adjusted to balance the force applied, the pages of a multi-leaved medium (e.g., a passbook) can be uniformly rolled up even when the rollers are not symmetrically located relative to the center of the multi-leaved medium. Further, when multi-leave media having various widths are employed, only the pressing forces need be adjusted, so that multi-leaved media having various sizes can be easily and precisely accommodated.

While there have been shown and described what are at present the preferred embodiments of the invention, it will be obvious to those skilled in the art that various changes and modifications may be made therein without departing from the scope of the invention as defined by the appended claims.

What is claimed is:

1. A page-turning device for turning a page of a multi-leaved medium comprised of a plurality of bound pages, said page-turning device comprising:

a multi-leaved medium feeding mechanism, for feeding and halting a multi-leaved medium in an open state within said page-turning device such that a surface of a page of said medium is exposed;

a roller shaft;

a plurality of rollers rotatably positioned on said roller shaft opposite said exposed surface of said page of said multi-leaved medium;

a support shaft;

a drive member for driving both said support shaft and said roller shaft to cause said plurality of rollers on said roller shaft to move said page of said multi-leaved medium when said rollers engage said exposed surface of said page;

a pair of pivotable arms pivotally located on said support shaft, said pivotable arms supporting said roller shaft relative to said support shaft and pressing said roller shaft downward to cause said plurality of rollers to engage said exposed surface of said page of said multi-leaved medium; and adjustment means for adjusting the pressure of said plurality of rollers on said roller shaft against said exposed surface of said page of said multi-leaved medium.

2. The page-turning device of claim 1 wherein said plurality of rollers are movably adjustable relative to one another along said roller shaft.

3. The page-turning device of claim 1, further including a positioning guide located adjacent said feeding mechanism for positioning, along one side, said multi-leaved medium relative to said plurality of rollers.

4. The page-turning device of claim 1 wherein said adjustment means for adjusting the pressure of said plurality of rollers comprises at least one adjustment member and a spring coupled thereto, said spring also operatively coupled to a respective one of said pivotable arms.

5. A printer for printing transaction information on a page of a multi-leaved medium comprised of multiple pages bound at one end, said printer comprising:

printing structure for printing the transaction information on a specific page of said medium when said medium is positioned within said printer; and a page turning device for turning said specific page of said multi-leaved medium, said page-turning device including a roller shaft, a plurality of rollers rotatably positioned on said roller shaft opposite said exposed surface of said page of said multi-leaved medium, a support shaft, a drive member for driving both said support shaft and said roller shaft to cause said plurality of rollers on said roller shaft to move said specific page of said multi-leaved medium when said rollers engage said exposed surface of said specific page, a pair of pivotable arms pivotally located on said support shaft, said pivotable arms supporting said roller shaft relative to said support shaft and pressing said roller shaft downward to cause said plurality of rollers to engage said exposed surface of said specific page of said multi-leaved medium, and adjustment means for adjusting the pressure of said plurality of rollers on said roller shaft against said exposed surface of said page of said multi-leaved medium.

6. The printer of claim 5 wherein said plurality of rollers are movably adjustable relative to one another along said roller shaft.

7. The printer of claim 5, further including a positioning guide located adjacent said feeding mechanism for positioning, along one side, said multi-leaved medium relative to said plurality of rollers.

8. The printer of claim 5 wherein said adjustment means for adjusting the pressure of said plurality of rollers comprises at least one adjustment member and a spring coupled thereto, said spring also operatively coupled to a respective one of said pivotable arms.

* * * * *